United States Patent [19]

Roger

[11] Patent Number: 5,076,720

[45] Date of Patent: Dec. 31, 1991

[54] DISPENSING CASINGS FOR SOLIDIFIED PRODUCTS

[76] Inventor: Carine Roger, 81 Boulevard Suchet, 75016 Paris, France

[21] Appl. No.: 479,423

[22] Filed: Feb. 13, 1990

[30] Foreign Application Priority Data

Feb. 14, 1989 [FR] France ..... 89 01878

[51] Int. Cl.[5] ..... B43K 21/08

[52] U.S. Cl. ..... 401/75; 401/68

[58] Field of Search ..... 401/68, 75, 69, 79, 401/116, 174

[56] References Cited

U.S. PATENT DOCUMENTS

| | | | |
|---|---|---|---|
| 2,309,000 | 1/1943 | Morrison | 401/79 X |
| 2,336,328 | 12/1943 | Whalen | 401/75 X |
| 2,815,123 | 12/1957 | Safianoff | 401/75 X |
| 2,823,796 | 2/1958 | Schwartz et al. | 401/75 |
| 2,827,164 | 3/1958 | Anderson | 401/75 |
| 3,197,024 | 7/1965 | Bau | 401/75 |
| 3,443,874 | 5/1969 | Pelli et al. | 401/68 X |
| 3,531,212 | 9/1970 | Landen | 401/75 X |
| 3,589,821 | 6/1971 | Barney et al. | 401/75 |
| 4,166,474 | 9/1979 | McArdle et al. | 401/75 X |
| 4,369,158 | 1/1983 | Woodruff et al. | 401/75 X |
| 4,605,330 | 8/1986 | Crowley et al. | 401/68 |

*Primary Examiner*—Danton D. DeMille

*Attorney, Agent, or Firm*—Browdy and Neimark

[57] ABSTRACT

A dispensing casing for solidified products (22), comprising a tubular body (1) provided, substantially in its median portion, with a piston (9) including threaded actuation means (17, 17$_1$) accessible from outside of the body (1). The body (1) is closed by a removable cover (5) and the piston (9) defines an opening (11*a*) for introduction of a product (22) filling at least an inner chamber (2) of the body. Closing means (17*a*) are provided for preventing the product (22) from flowing out after having filled the chamber (2).

20 Claims, 4 Drawing Sheets

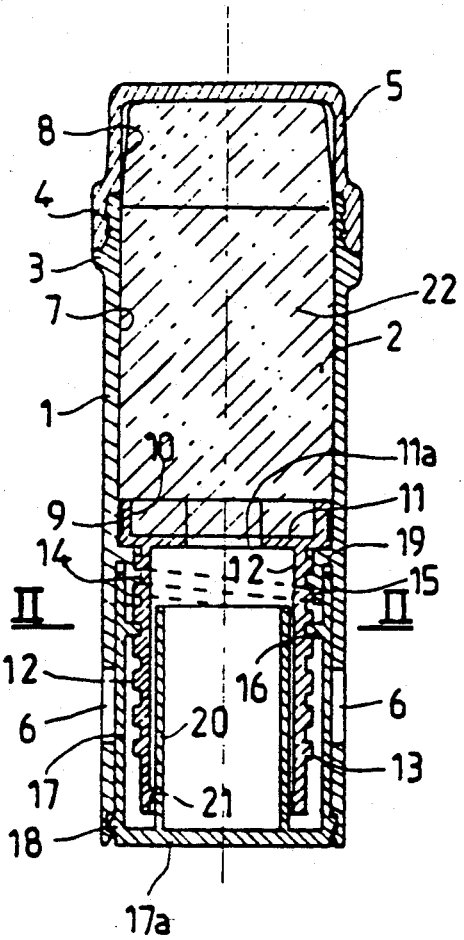
FIG.1
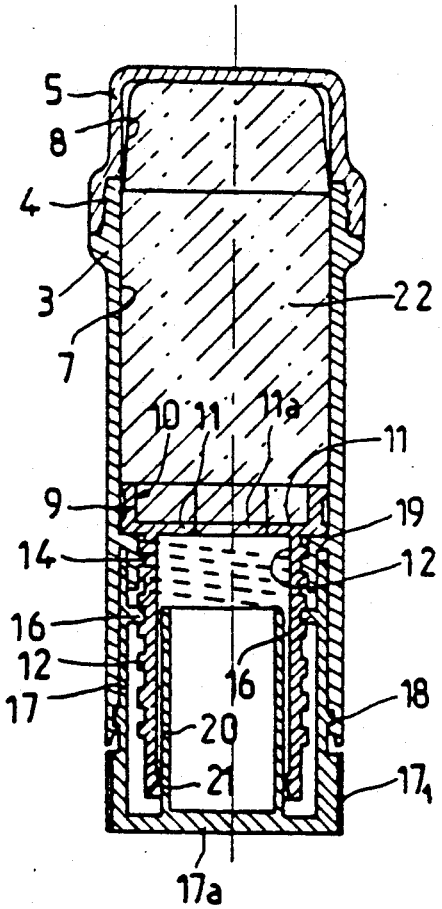
FIG.3
FIG.2
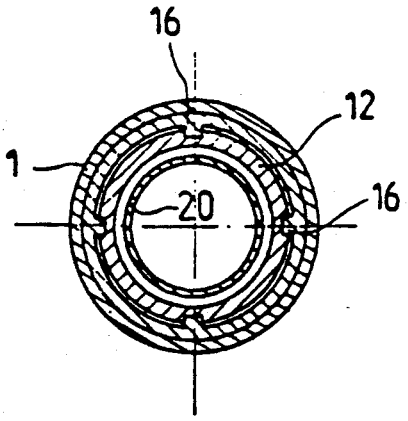
FIG.4
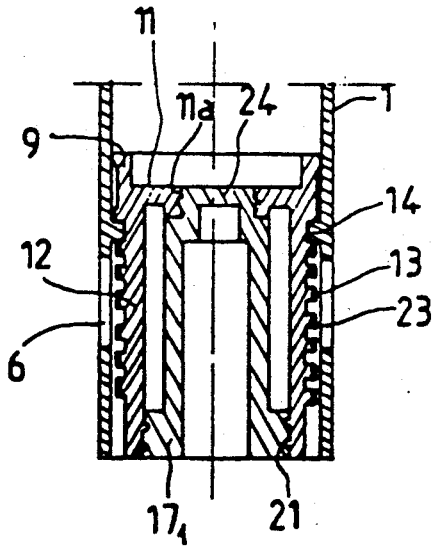

DISPENSING CASINGS FOR SOLIDIFIED PRODUCTS

FIELD AND BACKGROUND OF THE INVENTION

The present invention relates to casings for containing and using relatively rigid pasty products, notably make-ups such as lipsticks or also shoe polishes and similar products having a waxy consistency and which have to be applied by rubbing either on portions of the body or on various articles. In the following disclosure, these products are called solidified.

It is usual in the technique to mould these products of a waxy consistency when they are in the liquid state, then to place them in casings when they are solidified.

The casings, for example lipsticks or shoe polish sticks, are frequently provided with push-pieces in order to extract little by little the stick of product to be used, or they are provided with a screw system allowing extracting progressively the solidified product.

The present invention relates to a new casing which includes only a very small number of parts which can all be manufactured simply, notably by injection moulding of a synthetic material, and this while authorizing a filling operation without previous moulding of the waxy product stick, meaning that the casing as such is forming the mould.

The mounting and manufacturing operations are thus made very simple.

SUMMARY OF THE INVENTION

According to the invention, the dispensing casing for solidified products comprises a tubular body provided, substantially in its median portion, with a piston including threaded actuation means accessible from outside of the body, said body having a portion closed by a removable cover, said piston defining an opening for introduction therethrough under an un-solidified form of the product filling completely at least an inner chamber of said body, and closing means being provided at a second portion of the body for preventing the product from flowing out after having filled the chamber.

Various other features of the invention will become more apparent from the hereafter detailed description.

Embodiments of the object of the invention are shown by way of non limiting examples in the accompanying drawings.

BRIEF DESCRIPTION OF THE DRAWINGS

FIG. 1 is a transverse sectional view of the solidified product dispensing casing according to the invention.

FIG. 2 is a sectional outline along line II—II of FIG. 1.

FIG. 3 is a transverse sectional view similar to FIG. 1 of an alternative embodiment.

FIG. 4 is a partial transverse sectional view of a modification.

DETAILED DESCRIPTION

Figure 6:
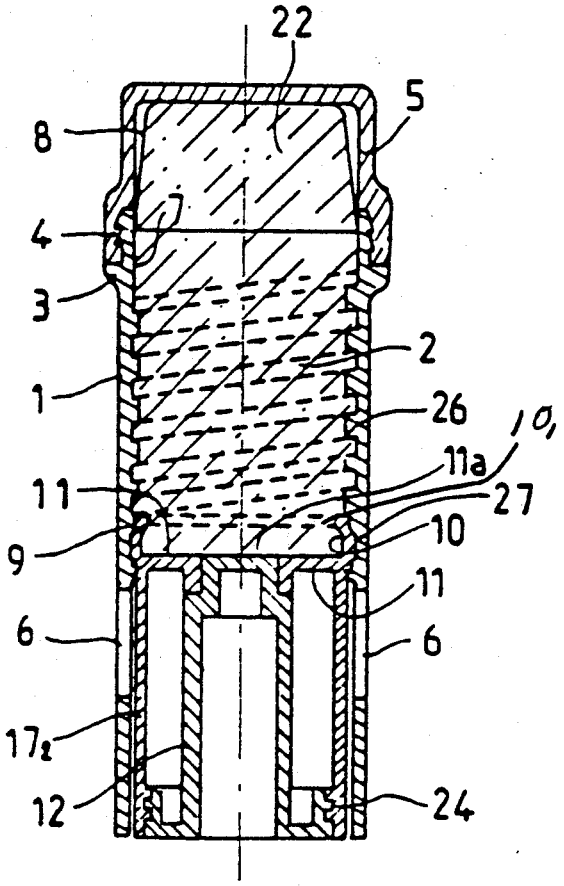
FIG. 6 is a transverse sectional view illustrating a particular feature.

The casing shown in the drawings comprises a body 1, made preferably, as well as the other parts described in the following disclosure, by injection moulding of a synthetic material.

Body 1 defines a chamber 2. At its upper portion, body 1 is formed with a shoulder 3 surmonted by a threaded portion 4 on which is screwed a cover 5. The bottom of body 1 is opened and formed laterally with at least one opening, and for example two openings 6 diametrically opposite as shown.

The drawings shows that the inner smooth wall 7 of body 1 is flush with the inner wall 8 of cover 5. It is advantageous that the inner wall 8 of the cover 5 defines a truncated cone or has a radius smaller than that of body 1 which is cylindrical.

A piston 9 is engaged inside body 1. The piston 9 has an inner wall 10 forming a cup advantageously undercut, or is provided with locking protrusions 10, (see FIG. 6). Piston 9 has bottom 11 to which is connected an open sheath 12.

Sheath 12 comprises a threading 13 meshing with thread 14 of an internal screw thread of a flange 15 formed inside body 1. The internal screw thread 13 is also meshing with fingers or ribs 16 formed by a cupel 17 engaged inside body 1 and in which it is latched by means of snap-ring 18 or similar.

Cupel 17 is guided at its upper portion in a groove 19 defined in the inner wall of body 1 and flange 15.

Cupel 17 includes also a bottom **17*a* from which extends a sleeve 20 the outer wall of which bears against a sealing member 21, for example and as shown a lip or bead, formed from the inner wall of sheath 12. In the embodiment of FIG. 1, it is advantageous that at least the portion of cupel 17 which is opposite opening 6** is knurled or made rough in any other way.

During manufacture of the casing, the body 1, which is advantageously made integrally by injection moulding of a synthetic material, is provided with the piston 9 also made by injection moulding of a synthetic material at the same time as sheath 12. Then, body 1 is provided with cover 5, thereafter this assembly is conveyed to a filling device in a position in which it is turned over 180° with respect to the position of the assembly shown in FIG. 1.

The filling product is poured in liquid form through an opening **11*a* formed in the bottom 11 of piston 9. After solidification of product 22, the device is then provided with the cupel 17 put in position by sliding the fingers 16 in the threading 13 until the snap-ring 18 is latched in body 1**.

The dispensing casing is then ready for use.

In order to obtain an access to product 22 contained in chamber 2, the only thing to do is to remove cover 5 in which the product has been moulded as wall as in body 1 up to the bottom 11 of piston 9. As product 22 wears out, it is possible to have it progressively coming out from body 1 by rotating cupel 17 via the opening or openings 6. Indeed, the cupel cannot be displaced axially any more due to its latching in body 1, and consequently the fingers or ribs 16 drive sheath 12 in rotation so that the screw thread of the latter is screwed in the internal screw thread 14 provided inside flange 15, thereby causing the displacement of piston 9 in the axial direction of body 1.

FIG. 3 illustrates a slight variant in which cupel 17 extends beyond the base of body 1 and forms a knurled knob $17_1$ about its bottom 17*a*. In this embodiment, openings 6 are omitted. All the other members are made as described in the foregoing with reference to FIG. 1 and consequently are designated by the same reference numerals.

In order to extract product 22, the only thing to do is, after having removed cover 5, to rotate knob $17_1$ and consequently the cupel 17 will rotate and drives the piston 9.

FIG. 4 shows a modification in which the internal screw thread 14 is directly formed from the inner wall of body 1 while the screw thread 13 includes, on its threads, striations or other protrusions 23 allowing rotating sheath 12 via the opening or openings 6. In this embodiment, the cupel which is now designated at $17_1$ is connected to the sheath via sealing member 21 similar to the sealing member 21 of FIGS. 1–3 and forms a plug 24 for the hole 11*a* of piston 9.

As shown in the drawing, this embodiment enables operating directly sheath 12 in order to screw it on the internal screw thread 14 and thereby providing a displacement of piston 9.

Figure 5:
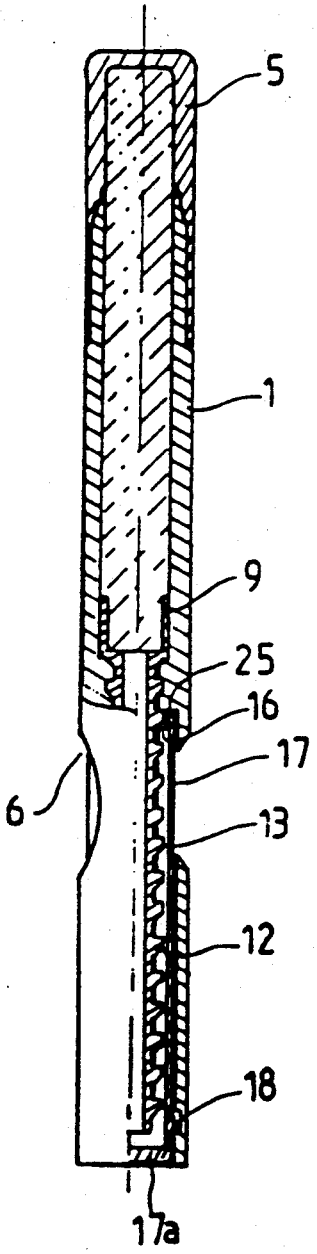
FIG. 5 is transverse sectional view, partly in section, of an alternative embodiment similar to that of FIG. 1.
Figure 7:
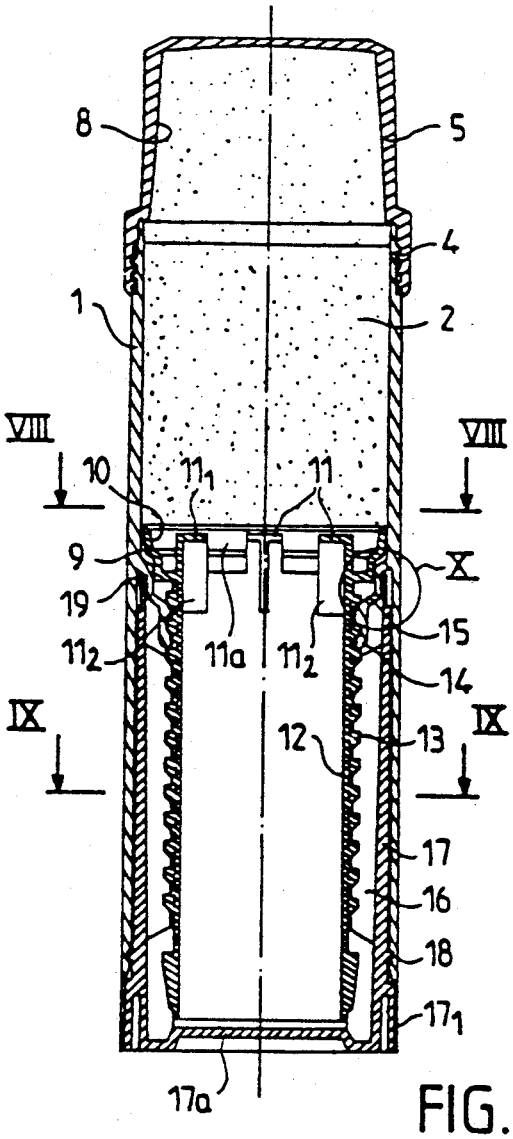
FIG. 7 is a transverse and sectional view of the casing in an embodiment similar to that of FIG. 3, showing the features which improve tightness of the casing and make possible a development of the invention.

FIG. 5 shows an embodiment quite similar to that of FIG. 1 in which body 1 is in the shape of an elongated member corresponding substantially to that of a fountain pen. In this embodiment, cupel 17 is as previously secured against a motion in the axial direction while being movable in rotation by snap-ring 18, and is guided at its free end in a notch 25 of body 1. The other portions of the casing are made in the same manner as previously described and are consequently designated by the same reference numerals.

FIG. 6 illustrates another variant according to which the portion of body 1 which extends between piston 9 and cover 5 comprises an internal screw thread 26, and piston 9 a screw thread 27. In this embodiment, the piston a is directly connected to a cupel $17_2$ and its hole 11*a* is closed by a plug 24 similar to that formed by cupel $17_1$ of FIG. 4.

As is clearly apparent from the drawing and the preceding description, the product 22 is poured and solidified inside body 1, it forms on itself a screw thread which, when the product has to be used, ensures its progressive ejection at the same time as piston 9 is driven in rotation and screwed inside internal screw thread 26.

The variant of FIG. 3 can be used in the embodiment of FIGS. 5 and 6, meaning that cupel 17 can be controlled by a knurled knob $17_1$.

Figure 10:
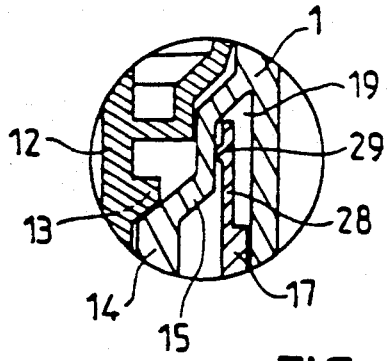
FIG. 10 is an enlarged sectional view of detail X of FIG. 7.

In the embodiment of FIGS. 7 to 12, the tightness between cupel 17 and body 1 is ensured by a thin lip 28 which is well visible in FIG. 10. It is advantageous that thin lip 28 forms a segment 29 resiliently pressed against the outer wall of flange 15. Thin lip 28 can also be of a slight frustoconical shape in order to increase the elastic pressure which it exerts on flange 15.

It is advantageous that bottom 11 of piston 9 is made of simple lugs $11_1$ supported by ribs $11_2$ between which opening 11*a* is defined.

The effect of lugs $11_1$ is to define an opening 11*a* in the shape of a spider the function of which is made clear in the following.

Figure 12:
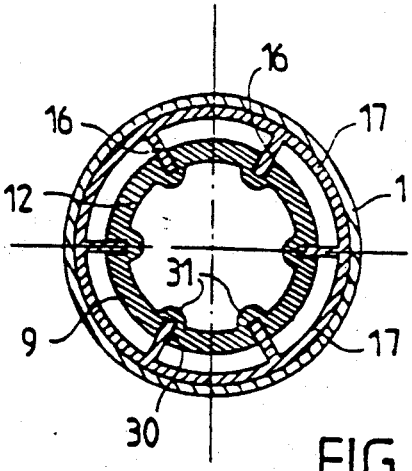
FIG. 12 is a sectional view similar to FIG. 9 of a slight variant.

When sheath 12 is thin-walled, it is advantageous, as shown in FIG. 12, that the fingers or ribs 16 are guided inside grooves 30 extending up to beads 31 formed in the inner wall of sheath 12.

Figure 13:
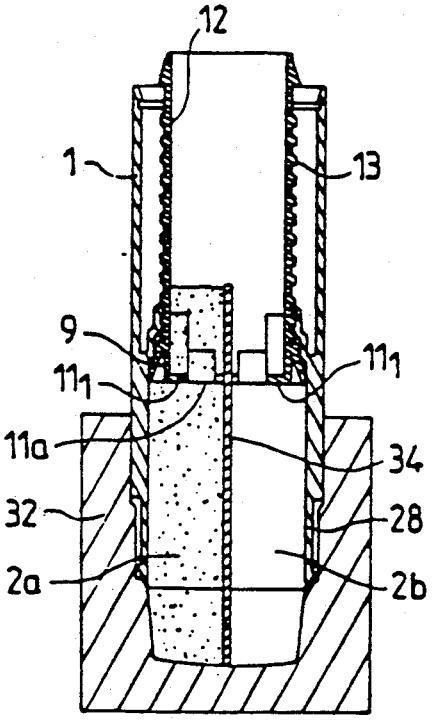
FIG. 13 is a sectional view illustrating a particular filling operation of a casing with several different products.

FIG. 13 shows a particular filling mode in which body 1 is put in position in a turned-over attitude in a mould 32 including a wall 34 which can be of any shape. The drawings show it as being plane.

Chamber 2 is thus divided into two chambers 2*a*, 2*b*, and a first quantity of the filling material is brought, for example cast, in chamber 2*a* extending via opening 11*a* between lugs $11_1$.

After sufficient hardening of the filling material, body 1, provided with piston 9, is removed from the mould, or while still leaving it in the mould, it is wall 34 which is removed and a second filling material is filled, for example cast, in chamber 2*b*. Thus, it is possible to have two products contained in the same casing, these products being different in nature, quantity or only in colour. Actually, it is possible to put in position more than two products by forming a wall 34 with several branches.

Figure 14:
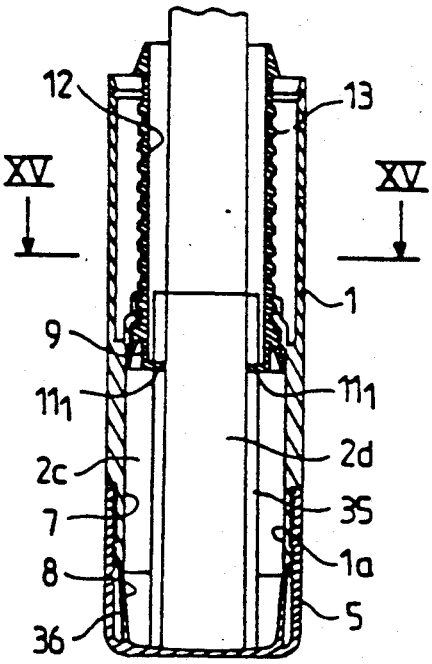
FIG. 14 is a sectional view illustrating a particular filling operation of a casing with several different products but which is a shape different from the casing of FIG. 13.
Figure 15:
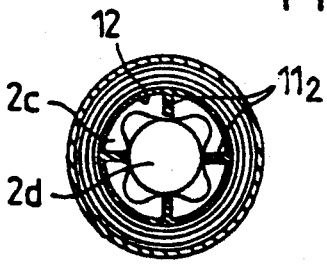
FIG. 15 is a sectional view along line XV—XV of FIG. 14.

FIGS. 14 and 15 show that it is also possible to carry out a filling operation by placing the various products in a more or less concentric manner and by using the casing as a mould as previously described.

Thus and as illustrated, the only thing to do is to put in position a tube 35 in the opening left free by lugs $11_1$, to introduce a first product in the outer chamber 2*c* or in the inner chamber 2*d*, to wait until it has hardened, to remove the tube and then to introduce in that of the two chambers which is not filled at least a second filling product.

If the tube 35 is provided with protruding wings, it is also possible, by first filling chambers 2*c*, to fill these chambers with different products, then after removal of tube 35 the wings of which extend between lugs 11, to introduce a filling product in chamber 2*d* and the spaces left free between the filling product of the various chambers 2*c* defined by the wings.

Figure 11:
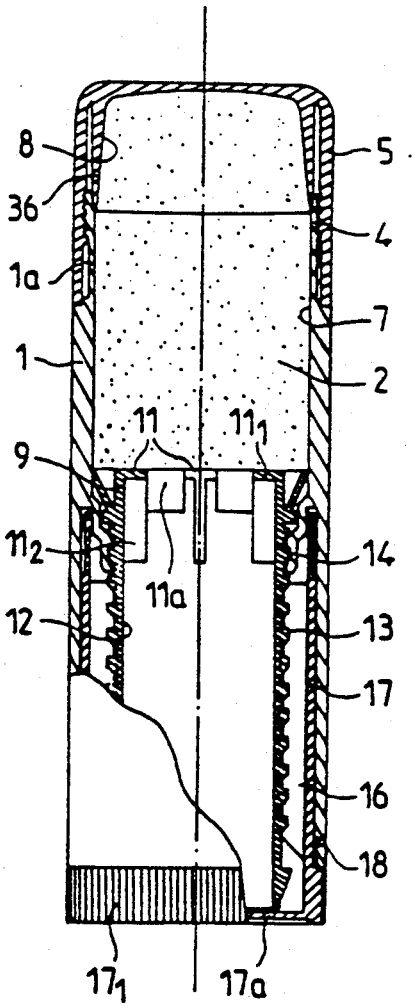
FIG. 11 is an elevation view, partly in section, similar to FIG. 7, illustrating a modification.
Figure 8:
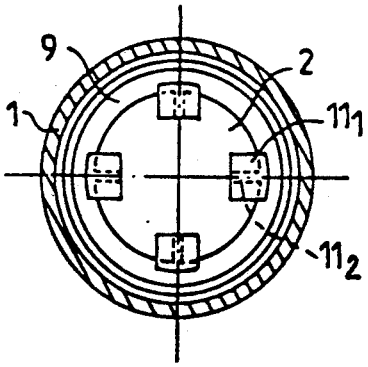
FIG. 8 is a sectional view along line VIII—VIII of FIG. 7.
Figure 9:
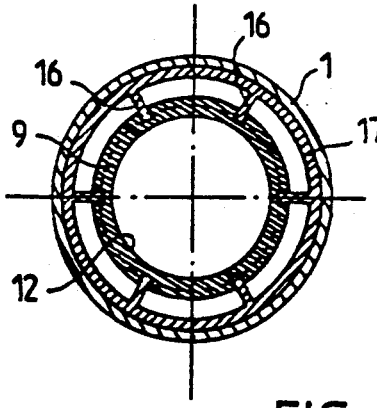
FIG. 9 is a sectional view along line IX—IX of FIG. 7.

FIGS. 14 and 15 show that a mould is not indispensable, as the latter is provided directly by body 1 and its cover 5 the wall 8 of which is advantageously formed of a thin flexible lip 36 which is well visible in FIG. 14 as well as in FIG. 11, this lip exerting an elastic pressure via its tapered end against the inner or outer wall 7 of body 1, which inner wall is as such advantageously made of a thinned-out portion 1*a* of body 1 so that cover 5, which is screwed onto this body, has generating lines which can be in alignment with those of the outer wall of body 1.

I claim:

1. A dispensing casing for solidified products, comprising a tubular body, a piston located substantially at a median portion of said body, said piston including threaded actuation means for extraction of the solidified product on said piston from outside said body, said body being connected to a rotatable cupel by a snap ring arrangement, and wherein said threaded actuation means further comprises a sheath prolongated downwardly from said piston, said sheath having threads meshing with at least a screw thread of said body as well as meshing with driving members of said cupel, said cupel being rotatable from outside of said body for driving said sheath and the piston, whereby causing an extraction of the solidified product, said body having an upper portion closed by a removable cover, said piston including an opening for introduction therethrough of the un-solidified form of the product, the solidified product filling completely at least an inner chamber of said body, closing means being provided at a lower portion of the body for preventing the product from flowing out after having filled said chamber, said sheath and cupel being connected by a sealing member made of a thin lip provided with a segment formed on said cupel and resiliently pressed against an outer wall of a flange which is part of the body and protrudes inside said body, said flange having thereon at least said screw thread of the body in mesh with said threads of said sheath, thereby forming the connection between said sheath and said cupel.

2. The casing as set forth in claim 1, wherein said piston comprises retaining protrusions for retaining said product.

3. The casing as set forth in claim 1, wherein said piston comprises an undercut wall for retaining said product.

4. The casing as set forth in claim 1, wherein the cover has a smooth inner wall, said inner wall defining a cylinder.

5. The casing as set forth in claim 1, wherein the cover has a smooth inner wall, said inner wall defining a truncated cone.

6. The casing as set forth in claim 1, wherein said driving members are made of fingers.

7. The casing as set forth in claim 1, wherein said driving members are made of ribs.

8. The casing as set forth in claim 1, wherein said piston has a bottom provided with a plug for closing said opening.

9. The casing as set forth in claim 1, wherein said cupel is guided inside said body, said body being formed with at least one opening for rotation of said cupel.

10. The casing as set forth in claim 9, wherein said cupel has a portion thereof which is accessible through said opening in said body said portion being knurled.

11. The casing as set forth in claim 9, wherein said cupel has portion thereof which is accessible through said opening in said body, said portion have a rough surface texture.

12. The casing as set forth in claim 1, wherein said body has an open base, and said cupel forms a knurled knob in substantial alignment with said base of said body.

13. The casing as set forth in claim 1, wherein said body defines guiding means for guiding the end of said cupel which is close to said driving members.

14. The casing as set forth in claim 13, wherein said guiding means is a groove.

15. The casing as set forth in claim 13, wherein said guiding means is a notch.

16. The casing as set forth in claim 1, wherein said sheath contains a plug formed at the end of said cupel.

17. The casing as set forth in claim 1, wherein said thread of said sheath has a surface which is knurled.

18. The casing as set forth in claim 1, wherein said thread of said sheath has a rough surface texture.

19. The casing as set forth in claim 1, wherein said body has an inner wall and said cover has a wall, with said inner wall of the body and said wall of the cover being in alignment.

20. The casing as set forth in claim 1, wherein said piston has a bottom, said bottom being made of lugs defining therebetween a spider-shaped opening.

* * * * *